US007984956B2

(12) United States Patent
Tabata et al.

(10) Patent No.: US 7,984,956 B2
(45) Date of Patent: Jul. 26, 2011

(54) LIQUID JET APPARATUS AND PRINTING APPARATUS

(75) Inventors: Kunio Tabata, Shiojiri (JP); Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 102 days.

(21) Appl. No.: 12/498,296

(22) Filed: Jul. 6, 2009

(65) Prior Publication Data

US 2009/0267979 A1 Oct. 29, 2009

Related U.S. Application Data

(62) Division of application No. 11/780,390, filed on Jul. 19, 2007, now Pat. No. 7,585,037.

(30) Foreign Application Priority Data

Jul. 24, 2006 (JP) ..... 2006-200353
Jul. 13, 2007 (JP) ..... 2007-184439

(51) Int. Cl.
*B41J 29/38* (2006.01)

(52) U.S. Cl. ..... 347/10; 347/11

(58) Field of Classification Search ..... 347/10
See application file for complete search history.

(56) References Cited

U.S. PATENT DOCUMENTS 2,915,589 A * 12/1959 Plant
4,254,439 A 3/1981 Fowler et al.
5,262,733 A * 11/1993 Nakajima et al.
5,283,658 A 2/1994 Hayashi et al.
5,406,314 A 4/1995 Kuehnle
5,475,405 A 12/1995 Widder et al.
5,675,296 A 10/1997 Tomikawa
5,894,314 A 4/1999 Tajika et al.
6,133,844 A 10/2000 Ahne et al.
6,267,519 B1 7/2001 Otsuki et al.
6,312,076 B1 * 11/2001 Taki et al. ..... 347/10
6,312,096 B1 11/2001 Koitabashi et al.
6,320,605 B1 11/2001 Ikeda et al.
6,344,811 B1 2/2002 Melanson
6,364,443 B1 4/2002 Katano et al.
6,431,676 B2 8/2002 Asauchi et al.

(Continued)

FOREIGN PATENT DOCUMENTS

EP 1594224 11/2005

(Continued)

OTHER PUBLICATIONS

U.S. Appl. No. 11/780,357, filed May 12, 2010, Final Office Action.

(Continued)

*Primary Examiner* — Matthew Luu
*Assistant Examiner* — Brian J Goldberg
(74) *Attorney, Agent, or Firm* — Maschoff Gilmore & Israelsen

(57) ABSTRACT

A liquid jet apparatus according to the present invention is a liquid jet apparatus including a plurality of nozzles, an actuator provided for each nozzle and connected to the respective nozzle, a drive waveform signal generation unit that generates a drive pulse, and a drive unit that applies the drive pulse to the actuator, wherein the drive unit includes a transistor pair, wherein the transistor pair: has two transistors connected to each other in a push-pull manner, and power-amplifies the drive pulse. The drive unit also includes a low-pass filter disposed between the transistor pair and the actuator.

10 Claims, 13 Drawing Sheets

U.S. PATENT DOCUMENTS

| | | | | |
|---|---|---|---|---|
| 6,443,547 | B1 | 9/2002 | Takahashi et al. | |
| 6,474,762 | B2 * | 11/2002 | Taki et al. | 347/10 |
| 6,652,055 | B2 | 11/2003 | Oikawa | |
| 6,776,469 | B2 | 8/2004 | Nozawa | |
| 7,038,534 | B2 * | 5/2006 | Hanzlik | |
| 7,083,274 | B2 * | 8/2006 | Morita | |
| 7,111,755 | B2 * | 9/2006 | Koyama et al. | |
| 7,170,544 | B2 | 1/2007 | Horiuchi | |
| 7,244,007 | B2 | 7/2007 | Ishizaki | |
| 7,252,355 | B2 | 8/2007 | Umeda | |
| 7,357,496 | B2 | 4/2008 | Silverbrook et al. | |
| 7,384,128 | B2 * | 6/2008 | Sheahan et al. | |
| 7,571,989 | B2 | 8/2009 | Ishizaki | |
| 7,576,763 | B2 | 8/2009 | Fitzpatrick et al. | |
| 7,581,802 | B2 | 9/2009 | Tabata et al. | |
| 7,585,037 | B2 | 9/2009 | Tabata et al. | |
| 7,717,530 | B2 | 5/2010 | Oshima | |
| 7,731,317 | B2 | 6/2010 | Oshima | |
| 7,748,812 | B2 | 7/2010 | Oshima | |
| 7,758,140 | B2 | 7/2010 | Oshima et al. | |
| 2002/0018085 | A1 | 2/2002 | Asauchi et al. | |
| 2002/0142733 | A1 * | 10/2002 | Nishinakagawa | |
| 2002/0163458 | A1 | 11/2002 | Jin | |
| 2003/0112297 | A1 | 6/2003 | Hiratsuka et al. | |
| 2003/0231179 | A1 * | 12/2003 | Suzuki | |
| 2004/0227807 | A1 | 11/2004 | Horiuchi | |
| 2005/0116977 | A1 | 6/2005 | Shinkawa et al. | |
| 2005/0231179 | A1 | 10/2005 | Ishizaki | |
| 2005/0248399 | A1 | 11/2005 | Kurokawa | |
| 2006/0132231 | A1 | 6/2006 | Ishii et al. | |
| 2006/0181342 | A1 | 8/2006 | Kanoh | |
| 2007/0079710 | A1 | 4/2007 | Ishizaki | |
| 2007/0120938 | A1 | 5/2007 | Fitzpatrick et al. | |
| 2007/0126845 | A1 | 6/2007 | Silverbrook et al. | |
| 2007/0165074 | A1 | 7/2007 | Ishizaki | |
| 2008/0018683 | A1 | 1/2008 | Oshima et al. | |
| 2008/0018685 | A1 | 1/2008 | Tabata et al. | |
| 2008/0018686 | A1 | 1/2008 | Oshima et al. | |
| 2008/0018687 | A1 | 1/2008 | Tabata et al. | |
| 2008/0100652 | A1 * | 5/2008 | Oshima et al. | |
| 2008/0186350 | A1 | 8/2008 | Oshima et al. | |
| 2008/0198191 | A1 | 8/2008 | Oshima | |
| 2008/0218545 | A1 * | 9/2008 | Oshima et al. | |
| 2009/0033698 | A1 * | 2/2009 | Suzuki et al. | |
| 2009/0066739 | A1 * | 3/2009 | Tabata et al. | |
| 2009/0174738 | A1 | 7/2009 | Oshima et al. | |
| 2009/0213152 | A1 | 8/2009 | Tabata et al. | |
| 2009/0267979 | A1 | 10/2009 | Tabata et al. | |
| 2009/0289980 | A1 | 11/2009 | Tabata et al. | |
| 2009/0303271 | A1 | 12/2009 | Tabata et al. | |
| 2010/0091059 | A1 | 4/2010 | Oshima et al. | |
| 2010/0097419 | A1 | 4/2010 | Oshima | |
| 2010/0118078 | A1 | 5/2010 | Oshima et al. | |
| 2010/0188452 | A1 | 7/2010 | Oshima | |

FOREIGN PATENT DOCUMENTS

| | | | |
|---|---|---|---|
| JP | 63-247059 | | 10/1988 |
| JP | 02-262705 | | 10/1990 |
| JP | 05-077456 | | 3/1993 |
| JP | 05-199044 | | 8/1993 |
| JP | 09-308264 | | 11/1997 |
| JP | 10-081013 | | 3/1998 |
| JP | 11-204850 | * | 7/1999 |
| JP | 2000-238262 | | 9/2000 |
| JP | 2000-245162 | | 9/2000 |
| JP | 2001-121697 | | 5/2001 |
| JP | 2003-001824 | * | 1/2003 |
| JP | 2003-237068 | | 8/2003 |
| JP | 2004-306434 | | 11/2004 |
| JP | 2005-035062 | | 2/2005 |
| JP | 2005-065068 | | 3/2005 |
| JP | 2005-075475 | | 3/2005 |
| JP | 2005-131928 | | 5/2005 |
| JP | 2005-322957 | | 11/2005 |
| JP | 2005-329710 | | 12/2005 |
| JP | 2006-025151 | | 1/2006 |
| JP | 2006-231882 | | 9/2006 |
| JP | 2006-256151 | | 9/2006 |
| JP | 2006-272907 | | 10/2006 |
| JP | 2007-069555 | | 3/2007 |
| JP | 2007-096364 | | 4/2007 |
| JP | 2007-144867 | | 6/2007 |
| JP | 2007-168172 | | 7/2007 |
| JP | 2007-190708 | | 8/2007 |
| JP | 2008-049698 | | 3/2008 |
| JP | 2008-049699 | | 3/2008 |
| JP | 2008-087467 | | 4/2008 |

OTHER PUBLICATIONS

U.S. Appl. No. 11/849,582, filed Apr. 19, 2010, Notice of Allowance.
U.S. Appl. No. 11/923,448, filed Apr. 28, 2010, Final Office Action.
U.S. Appl. No. 11/780,379, filed Mar. 3, 2010, Office Action.
U.S. Appl. No. 12/351,472, filed Jan. 4, 2010, Notice of Allowance.
U.S. Appl. No. 12/340,940, filed Apr. 12, 2010, Notice of Allowance.
U.S. Appl. No. 12/161,148, filed Mar. 30, 2010, Office Action.
U.S. Appl. No. 12/161,201, filed Jul. 17, 2008, Oshima et al.
U.S. Appl. No. 12/637,412, filed Dec. 14, 2009, Oshima et al.
U.S. Appl. No. 12/689,926, filed Jan. 19, 2010, Oshima et al.
U.S. Appl. No. 11/780,301, filed Jun. 27, 2008, Office Action.
U.S. Appl. No. 11/780,301, filed Feb. 20,2009, Final Office Action.
U.S. Appl. No. 11/780,301, filed Jun. 16, 2009, Notice of Allowance.
U.S. Appl. No. 11/780,357, filed Oct. 28, 2009, Office Action.
U.S. Appl. No. 11/780,390, filed Apr. 8, 2009, Notice of Allowance.
U.S. Appl. No. 11/849,582, filed May 28, 2008, Office Action.
U.S. Appl. No. 11/849,582, filed Dec. 30,2009, Final Office Action.
U.S. Appl. No. 11/923,448, filed Nov. 27, 2009, Office Action.
U.S. Appl. No. 11/780,379, filed Aug. 20, 2010, Final Office Action.*
U.S. Appl. No. 12/161,148, filed Sep. 16, 2010, Final Office Action.*
U.S. Appl. No. 12/161,201, filed Sep. 28, 2010, Office Action.*
U.S. Appl. No. 12/509,915, filed Sep. 30, 2010, Office Action.*
U.S. Appl. No. 12/637,412, filed Aug. 23, 2010, Office Action.*
U.S. Appl. No. 12/752,367, filed Oct. 8, 2010, Office Action.*
U.S. Appl. No. 12/689,926, filed Nov. 30, 2010, Office Action.
U.S. Appl. No. 12/498,286, mailed Dec. 17, 2010, Notice of Allowance.
U.S. Appl. No. 11/780,390, mailed Apr. 8, 2009, Notice of Allowance.
U.S. Appl. No. 12/752,367, mailed Apr. 1, 2010.

* cited by examiner

| | |
|---|---|
| ADDRESS 1 | NOZZLE 1 SMALL INK DROPLET WAVEFORM DATA |
| ADDRESS 2 | NOZZLE 1 MEDIUM INK DROPLET WAVEFORM DATA |
| ADDRESS 3 | NOZZLE 1 LARGE INK DROPLET WAVEFORM DATA |
| ADDRESS 4 | NOZZLE 2 SMALL INK DROPLET WAVEFORM DATA |
| ADDRESS 5 | NOZZLE 2 MEDIUM INK DROPLET WAVEFORM DATA |
| ADDRESS 6 | NOZZLE 2 LARGE INK DROPLET WAVEFORM DATA |
| ⋮ | ⋮ |
| ADDRESS M-5 | NOZZLE N-1 SMALL INK DROPLET WAVEFORM DATA |
| ADDRESS M-4 | NOZZLE N-1 MEDIUM INK DROPLET WAVEFORM DATA |
| ADDRESS M-3 | NOZZLE N-1 LARGE INK DROPLET WAVEFORM DATA |
| ADDRESS M-2 | NOZZLE N SMALL INK DROPLET WAVEFORM DATA |
| ADDRESS M-1 | NOZZLE N MEDIUM INK DROPLET WAVEFORM DATA |
| ADDRESS M | NOZZLE N LARGE INK DROPLET WAVEFORM DATA |

FIG.11A

| | |
|---|---|
| ADDRESS 1 | SMALL INK DROPLET WAVEFORM DATA A |
| ADDRESS 2 | MEDIUM INK DROPLET WAVEFORM DATA A |
| ADDRESS 3 | LARGE INK DROPLET WAVEFORM DATA A |
| ADDRESS 4 | SMALL INK DROPLET WAVEFORM DATA B |
| ADDRESS 5 | MEDIUM INK DROPLET WAVEFORM DATA B |
| ADDRESS 6 | LARGE INK DROPLET WAVEFORM DATA B |
| ADDRESS 7 | SMALL INK DROPLET WAVEFORM DATA C |
| ADDRESS 8 | MEDIUM INK DROPLET WAVEFORM DATA C |
| ADDRESS 9 | LARGE INK DROPLET WAVEFORM DATA C |
| ADDRESS 10 | SMALL INK DROPLET WAVEFORM DATA D |
| ADDRESS 11 | MEDIUM INK DROPLET WAVEFORM DATA D |
| ADDRESS 12 | LARGE INK DROPLET WAVEFORM DATA D |
| ⋮ | ⋮ |

FIG.11B

LIQUID JET APPARATUS AND PRINTING APPARATUS

This application is a divisional of Ser. No. 11/780,390 filed Jul. 19, 2007 which is incorporated by reference and claimed priority to Japanese application no. 2006-200353 filed Jul. 24, 2006 and Japanese application no. 2007-184439 filed Jul. 13, 2007.

BACKGROUND

1. Technical Field

The present invention relates to a liquid jet apparatus and printing apparatus arranged to print predetermined letters and images by emitting microscopic droplets of liquids from a plurality of nozzles to form the microscopic particles (dots) thereof on a printing medium.

2. Related Art

An inkjet printer as one of such printing apparatuses, which is generally low-price and easily provides high quality color prints, has widely spread not only to offices but also to general users along with the widespread of personal computers and digital cameras.

In recent inkjet printers, printing in fine tone is required. Tone denotes a state of density of each color included in a pixel expressed by a liquid dot, the size of the dot corresponding to the color density of each pixel is called a tone grade, and the number of the tone grades capable of being expressed by a liquid dot is called a tone number. Fine tone denotes that the tone number is large. In order to change the tone grade, it is required to modify a drive pulse to an actuator provided to a liquid jet head. In the case in which a piezoelectric element is used as the actuator, since the amount of displacement of the piezoelectric element (distortion of a diaphragm, to be precise) becomes large when the voltage value applied to the piezoelectric element becomes large, the tone grade of the liquid dot can be changed very accurately.

Therefore, in JP-A-2003-1824, a plurality of drive pulses with different wave heights are combined and joined, the drive pulses are commonly output to the piezoelectric elements of the nozzles of the same color provided to the liquid jet head, a drive pulse corresponding to the tone grade of the liquid dot to be formed is selected for every nozzle out of the plurality of drive pulses, the selected drive pulses are supplied to the piezoelectric elements of the corresponding nozzles to emit droplets of the liquid different in amount, thereby achieving the required tone grade of the liquid dot.

However, there is a problem that the waveform of the drive pulse is distorted by the parasitic inductance, the parasitic capacitance, and the resistance of the wiring of the drive circuit, and the capacitance of the actuator, such as a piezoelectric element, and moreover, the amount of the waveform distortion varies in accordance with the number of actuators, such as piezoelectric elements, driven by the drive pulse. The waveform distortion of the drive pulse leads to variation in the amount of the liquid, causing variation in the size of the liquid dot, thus leading to degradation of the print quality. It should be noted that the variation in the amount of the liquid also depends on the individual difference of the nozzle or the actuator. Further, in the case in which a plurality of drive pulses is combined in chronological order and joined to each other, the drive pulse corresponding to the tone grade of a liquid dot to be formed is selected for every nozzle from the plurality of drive pulses, and the selected drive pulse is applied to the actuator of the corresponding nozzle, there is caused a shift in the liquid jet emission timing between the nozzles of the actuators for which the different drive pulses are selected, thus the liquid dot forming (or landing) positions vary and cause degradation of the print quality.

BRIEF SUMMARY OF THE INVENTION

The present invention includes a liquid jet apparatus and a printing apparatus capable of preventing waveform distortion of the drive pulse, suppressing and preventing the variation in the amount of liquid jetted, and preventing the shift in liquid jet emission timing, thereby achieving high-quality, fine tone, printing.

A liquid jet apparatus according to the present invention is a liquid jet apparatus including a plurality of nozzles, an actuator provided for each nozzle and connected to the respective nozzle, a drive waveform signal generation unit that generates a drive pulse, and a drive unit that applies the drive pulse to the actuator, wherein the drive unit includes a transistor pair, wherein the transistor pair: has two transistors connected to each other in a push-pull manner, and power-amplifies the drive pulse. The drive unit also includes a low-pass filter disposed between the transistor pair and the actuator.

According to the liquid jet apparatus of the invention described above, since only one actuator is connected to the drive unit composed of the transistor pair and the low-pass filter, waveform distortion of the drive pulse can be prevented, therefore, variation in the amount of liquid to be emitted can be suppressed and prevented making it possible to perform high quality, fine tone, printing.

Further, it is preferable that the drive unit includes a modulator unit provided for pulse-modulating the drive pulse to produce a modulated signal, and a gate drive unit driving the transistor pair in accordance with the modulated signal.

Further, it is preferable that the liquid jet apparatus includes a waveform data memory for storing waveform data corresponding to the actuators, wherein the drive waveform signal generation unit generates the drive pulse for each actuator in accordance with the corresponding waveform data stored in the waveform data memory.

According to the liquid jet apparatus of the invention described above, by generating the drive waveform signal corresponding to the actuator of the individual drive circuit and the nozzle, the variation in the amount of liquid to be emitted among the nozzles can be suppressed and prevented, thus high quality, fine tone, printing becomes possible.

Further, it is preferable that the drive waveform signal generation unit generates the drive waveform signals simultaneously with the timing of emitting the liquid jet from the nozzles to all of the actuators corresponding to the nozzles from which the liquid jet is to be emitted.

According to the liquid jet apparatus of the invention described above, the shift of the liquid jet emission timing among the nozzles can be prevented, thus high quality, fine tone, printing becomes possible.

Further, it is preferable that the drive unit is disposed adjacent to the actuators as an integrated circuit.

Further, the printing apparatus of the invention is preferably a printing apparatus provided with the liquid jet apparatus described above.

According to the printing apparatus of the invention described above, the variation in the amount of liquid to be emitted can be suppressed and prevented, thus high quality, fine tone, printing becomes possible. Further, by disposing the drive unit adjacent to the actuators as an integrated circuit, power loss can be reduced to achieve low power consumption, and at the same time, the plurality of liquid jet heads can efficiently be arranged, thus reducing the size of the printing apparatus.

BRIEF DESCRIPTION OF THE DRAWINGS

FIGS. 11A and 11B are explanatory diagrams of a waveform data memory;

DETAILED DESCRIPTION OF THE PREFERRED EMBODIMENTS

An embodiment will be explained with reference to the drawings, using a printing apparatus for printing letters and images on a print medium by emitting a liquid, as an example of the present invention.

Figure 1A:
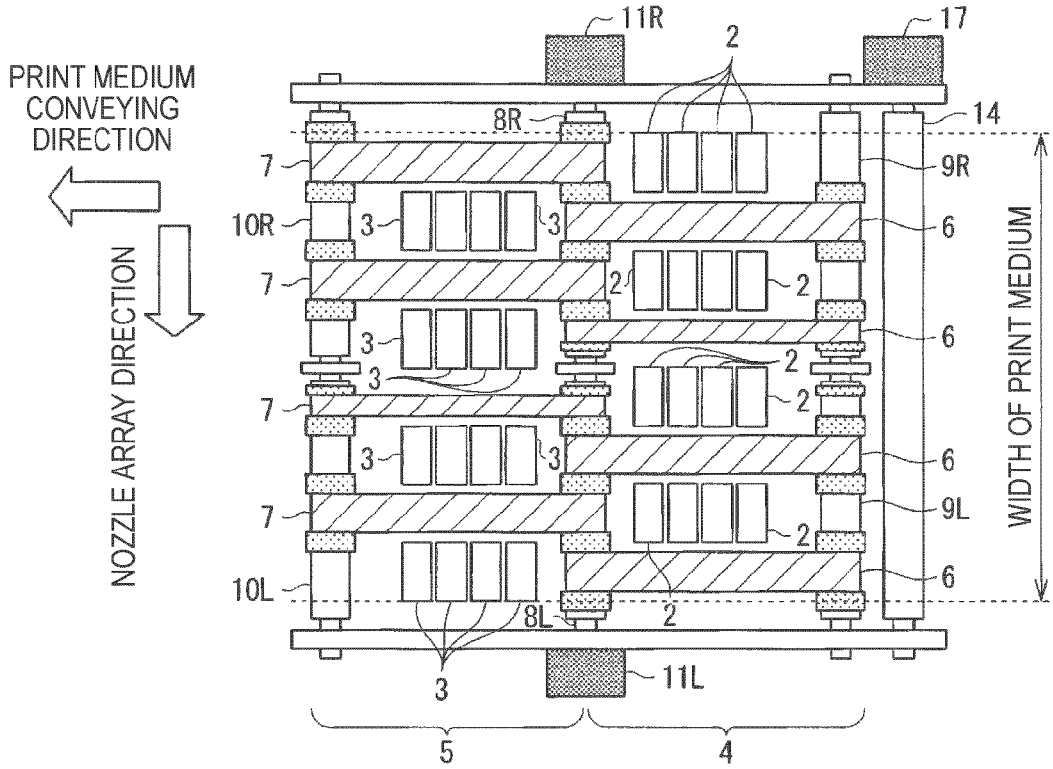
FIG. 1A shows a top view of an overall configuration showing an embodiment of a line head printing apparatus applying the liquid jet apparatus according to the present invention.
Figure 1B:
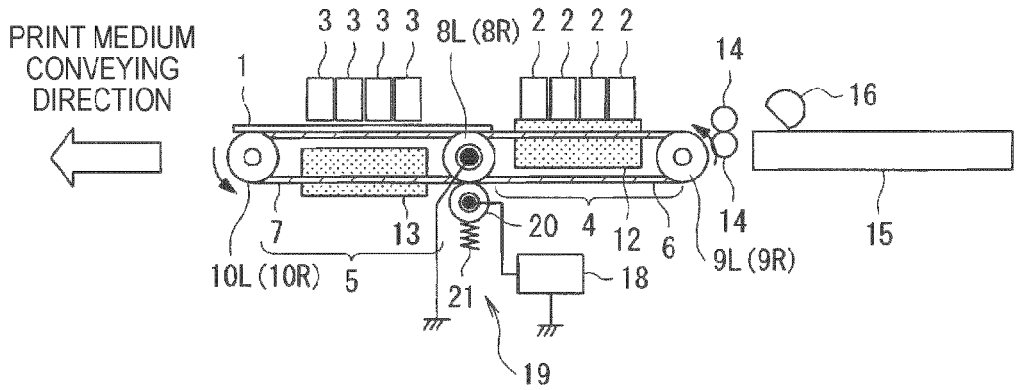
FIG. 1B is a front view of the line head ink jet printer of FIG. 1A.

FIGS. 1A and 1B are schematic configuration views of the printing apparatus according to the present embodiment, wherein FIG. 1A is a top plain view thereof, and FIG. 1B is a front view thereof. In FIG. 1, in the line head printing apparatus, a print medium 1 is conveyed from the upper right to the lower left of the drawing along the arrow direction, and printing occurs in a print area in the middle of the conveying path. It should be noted that the liquid jet heads of the present embodiment are not arranged in one line, but are arranged in two lines.

A first line of liquid jet heads 2 are arranged on the "upstream" side in the direction of conveyance of the print medium 1. A second line of liquid jet heads 3 are arranged on the downstream side. A first conveying section 4 for conveying the print medium 1 is disposed below the first liquid jet head 2, and a second conveying section 5 is disposed below the second liquid jet head 3. The first conveying section 4 is composed of four first conveying belts 6 disposed with predetermined intervals in the direction (hereinafter also referred to as a nozzle array direction) traversing the conveying direction of the print medium 1, the second conveying section 5 is similarly composed of four second conveying belts 7 disposed with predetermined intervals in the nozzle array direction.

The four first conveying belts 6 and the similar four second conveying belts 7 are alternated with respect to each other. In the present embodiment, out of the conveying belts 6 and 7, the two first and second conveying belts 6 and 7 in the right side in the nozzle array direction are distinguished from the two first and second conveying belts 6 and 7 in the left side in the nozzle array direction. In other words, an overlapping portion of two of the first and second conveying belts 6 and 7 in the right side in the nozzle array direction is provided with a right side drive roller 8R, an overlapping portion of two of the first and second conveying belts 6 and 7 in the left side in the nozzle array direction is provided with a left side drive roller 8L, a right side first driven roller 9R and left side first driven roller 9L are disposed on the upstream side thereof, and a right side second driven roller 10R and left side second driven roller 10L are disposed on the downstream side thereof. Although these rollers may appear to be single rollers, they are actually decoupled in the center portion of FIG. 1A.

Further, the two first conveying belts 6 in the right side in the nozzle array direction are wound around the right side drive roller 8R and the right side first driven roller 9R, the two first conveying belts 6 in the left side in the nozzle array direction are wound around the left side drive roller 8L and the left side first driven roller 9L, the two second conveying belts 7 in the right side in the nozzle array direction are wound around the right side drive roller 8R and the right side second driven roller 10R, and the two second conveying belts 7 in the left side in the nozzle array direction are wound around the left side drive roller 8L and the left side second driven roller 10L. Further, a right side electric motor 11R is connected to the right side drive roller 8R, and a left side electric motor 11L is connected to the left side drive roller 8L. Therefore, when the right side electric motor 11R drives the right side drive roller 8R, the first conveying section 4 composed of the two first conveying belts 6 in the right side in the nozzle array direction and similarly the second conveying section 5 composed of the two second conveying belts 7 in the right side in the nozzle array direction move in sync with each other and at the same speed when the left side electric motor 11L drives the left side drive roller 8L, the first conveying section 4 composed of the two first conveying belts 6 in the left side in the nozzle array direction and similarly the second conveying section 5 composed of the two second conveying belts 7 in the left side in the nozzle array direction move in sync with each other and at the same speed.

It should be noted that by arranging the rotational speeds of the right side electric motor 11R and the left side electric motor 11L to be different from each other, the conveying speeds in the left and right in the nozzle direction can be different from each other; specifically, by arranging the rotational speed of the right side electric motor 11R higher than the rotational speed of the left side electric motor 11L, the conveying speed in the right side in the nozzle array direction can be made higher than that in the left side, and by arranging the rotational speed of the left side electric motor 11L higher than the rotational speed of the right side electric motor 11R, the conveying speed in the left side in the nozzle array direction can be made higher than that in the right side.

The first liquid jet heads 2 and the second liquid jet heads 3 include a set of colors, yellow (Y), magenta (M), cyan (C), and black (K) shifted in the conveying direction of the print medium 1. The liquid jet heads 2 and 3 are supplied with liquids from liquid tanks (not shown) of their respective colors via liquid supply tubes (not shown). Each of the liquid jet heads 2 and 3 is provided with a plurality of nozzles formed in the nozzle array direction and by emitting the necessary amount of liquid jet from the respective nozzles simultaneously to the necessary positions microscopic liquid dots are formed on the print medium 1. By performing the process described above by the set of colors, one-pass print can be achieved by making the print medium 1 conveyed by the first and second conveying sections 4 and 5 pass therethrough once. In other words, the area in which the liquid jet heads 2 and 3 are disposed corresponds to the print area.

As a method of emitting liquid jets from each of the nozzles of the liquid jet heads, an electrostatic method, a piezoelectric method, a film boiling jet method and so on, can be explained. In the electrostatic method, when a drive signal is provided to an electrostatic gap as an actuator, a diaphragm in the cavity is displaced to cause pressure variation in the cavity, and the liquid is emitted from the nozzle in accordance with the pressure variation. In the piezoelectric method, when a drive signal is provided to a piezoelectric element as an actuator, a diaphragm in the cavity is displaced to cause pressure variation in the cavity, and the liquid is emitted from the nozzle in accordance with the pressure variation. In the film boiling jet method, a microscopic heater is provided in the cavity, and is instantaneously heated to be at a temperature higher than 300° C. to make the liquid enter the boiling state to generate a bubble, thus causing a pressure variation and making the liquid be emitted from the nozzle. The present invention can apply to any of the above liquid jet methods, and among others, the invention is particularly suitable for the piezoelectric element, capable of adjusting an amount of the liquid jet by controlling the wave height and/or gradient of the increase or decrease in the voltage of the drive signal.

The liquid jet nozzles of the first liquid jet heads 2 are provided between the four first conveying belts 6 of the first conveying section 4, and the liquid jet nozzles of the second liquid jet heads 3 are provided between the four second conveying belts 7 of the second conveying section 5. Although this is for cleaning each of the liquid jet heads 2 and 3 with a cleaning section described later, the entire surface is not printed by one-pass printing if either one of the liquid jet heads is used independently. Therefore, the first liquid jet heads 2 and the second liquid jet heads 3 are disposed alternately in the conveying direction of the print head 1 in order to compensate for each other's unprintable areas.

Disposed below the first liquid jet heads 2 is a first cleaning cap 12 for cleaning the first liquid jet heads 2, and disposed below the second liquid jet heads 3 is a second cleaning cap 13 for cleaning the second liquid jet head 3. Each of the cleaning caps 12 and 13 is formed to allow the cleaning caps to pass between the four first conveying belts 6 of the first conveying section 4 and between the four second conveying belts 7 of the second conveying section 5. Each of the cleaning caps 12 and 13 is composed of a cap body having a rectangular shape with a top, covering the nozzles provided on the lower surface, namely the nozzle surface of the liquid jet heads 2 and 3, and capable of adhering to the nozzle surface, a liquid absorbing body disposed at the bottom of the cap body, a peristaltic pump connected to the bottom of the cap body, and an elevating device for moving the cap body up and down. The cap body is moved up by the elevating device to be adhered to the nozzle surface of the liquid jet heads 2 and 3. By causing negative pressure in the cap body using the peristaltic pump in the present state, the liquid and bubbles are suctioned from the nozzle openings on the nozzle surface of the liquid jet heads 2 and 3, thus the cleaning of the liquid jet heads 2 and 3 can be performed. After the cleaning is completed, each of the cleaning caps 12 and 13 is moved down.

On the upstream side of the first driven rollers 9R and 9L, there are provided a pair of gate rollers 14 for adjusting the feed timing of the print medium 1 from a feeder section 15 and at the same time correcting the skew of the print medium 1. The skew denotes a rotation of the print medium 1 with respect to the conveying direction. Further, above the feeder section 15, there is provided a pickup roller 16 for feeding the print medium 1. A gate roller motor 17 drives the gate rollers 14.

A belt charging device 19 is disposed below the drive rollers 8R and 8L. The belt charging device 19 is composed of a charging roller 20 having a contact with the first conveying belts 6 and the second conveying belts 7 via the drive rollers 8R and 8L, a spring 21 for pressing the charging roller 20 against the first conveying belts 6 and the second conveying belts 7, and a power supply 18 for providing charge to the charging roller 20. The belt charging device 19 charges the first conveying belts 6 and the second conveying belts 7 by providing them with the charge from the charging roller 20. Since the belts are generally made of a moderate or high resistivity material or an insulating material, when the they are charged by the belt charging device 19, the charge applied on the surface thereof causes the print medium 1, made similarly of a high resistivity material or an insulating material, to achieve dielectric polarization, and the print medium 1 can be adhered to the belt by the electrostatic force caused between the charge generated by the dielectric polarization and the charge on the surface of the belt. It should be noted that as the belt charging device 19, a corotron for showering charge can also be used.

Therefore, according to the present printing apparatus, when the surfaces of the first conveying belts 6 and the second conveying belts 7 are charged by the belt charging device 19, the print medium 1 is fed from the gate roller 14, and the print medium 1 is pressed against the first conveying belts 6 by a sheet pressing roller composed of a spur or a roller (not shown), the print medium 1 is adhered to the surfaces of the first conveying belts 6 under the action of dielectric polarization. When the electric motors 11R and 11L drive the drive rollers 8R and 8L, the drive force is transmitted to the first driven rollers 9R and 9L via the first conveying belts 6.

Thus, the first conveying belts 6 are moved to the downstream side of the conveying direction while adhering to the print medium 1, printing is performed by emitting liquid from the nozzles formed on the first liquid jet heads 2 while moving the print medium 1 below the first liquid jet heads 2. When the printing by the first liquid jet heads 2 is complete, the print medium 1 is moved to the downstream side of the conveying direction to be switched to the second conveying belts 7 of the second conveying section 5. As described above, since the second conveying belts 7 are also provided with the charge on the surface thereof by the belt charging device 19, the print medium 1 is adhered to the surfaces of the second conveying belts 7 under the action of the dielectric polarization.

The second conveying belts 7 are moved to the downstream side of the conveying direction, printing is performed by emitting liquid from the nozzles formed on the second liquid jet heads 3 while moving the print medium 1 below the second liquid jet heads 3. After printing by the second liquid jet heads 3 is complete, the print medium 1 is moved further to the downstream side of the conveying direction, the print medium 1 is ejected to a catch tray while separating it from the surfaces of the second conveying belts 7 by a separating device (not shown).

When cleaning of the first and second liquid ejection heads 2 and 3 becomes necessary, as described above, the first and second cleaning caps 12 and 13 are raised to be adhered to the nozzle surfaces of the first and second liquid jet heads 2 and 3, the cleaning is performed by applying negative pressure to the inside of the caps to suction ink droplets and bubbles from the nozzles of the first and second liquid jet heads 2 and 3, and then, the first and second cleaning caps 12 and 13 are moved down.

Figure 2:
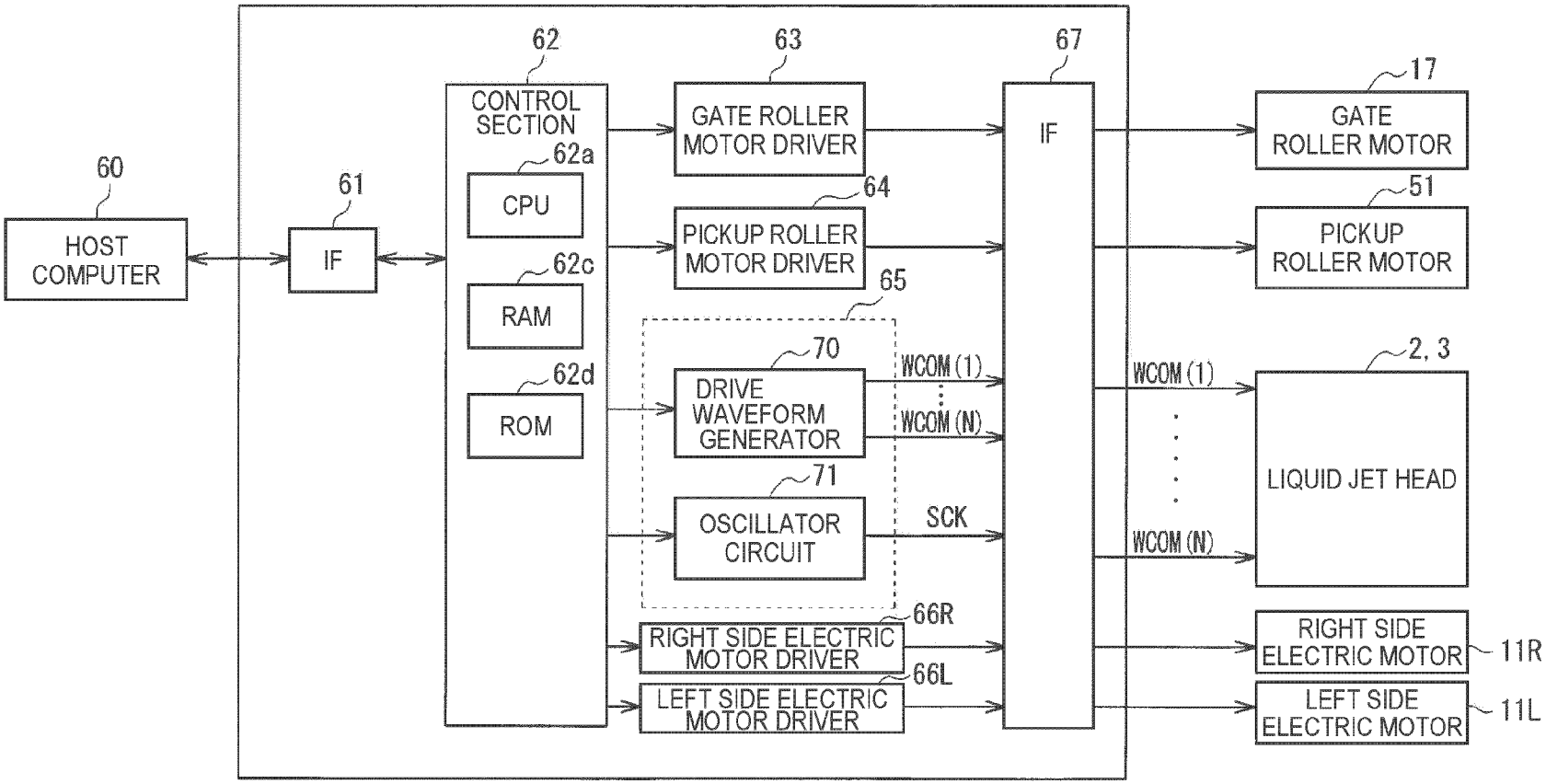
FIG. 2 is a block diagram of a control device of the printing apparatus shown in FIG. 1.

Inside the printing apparatus there is provided a control device for controlling the apparatus itself. The control device is, as shown in FIG. 2, for controlling the printing apparatus, the feeder device, and so on, based on print data input from a host computer 60, such as a personal computer or a digital camera, thereby performing the print process on the print medium 1. Further, the control device includes an input interface section 61 for receiving print data input from the host computer 60, a control section 62 formed of a microcomputer for performing the print process based on the print data input from the input interface section 61, a gate roller motor driver 63 for driving the gate roller motor 17, a pickup roller motor driver 64 for driving a pickup roller motor 51 for driving the pickup roller 16, a head driver 65 for driving the liquid jet heads 2 and 3, a right side electric motor driver 66R for driving the right side electric motor 11R, a left side electric motor driver 66L for driving the left side electric motor 11L, and an interface 67 for converting the output signals of the drivers 63, 64, 65, 66R, and 66L into drive signals used in the gate roller motor 17, the pickup roller motor 51, the liquid jet heads 2 and 3, the right side electric motor 11R, and the left side electric motor 11L.

The control section 62 is provided with a central processing unit (CPU) 62*a* for performing various processes, such as the print process, a random access memory (RAM) 62*c* for temporarily storing the print data input via the input interface 61 and various kinds of data used in performing the print process of the print data, and for temporarily developing an application program, such as for the print process, and a read-only memory (ROM) 62*d* formed of a nonvolatile semiconductor memory and for storing the control program executed by the CPU 62*a* and so on. When the control section 62 receives the print data (image data) from the host computer 60 via the interface section 61, the CPU 62*a* performs a predetermined process on the print data to output printing data (drive pulse selection data SI & SP) regarding which nozzle emits the liquid and/or how much liquid is emitted, and further outputs the control signals to the respective drivers 63, 64, 65, 66R, and 66L based on the printing data and the input data from the various sensors. When the control signals are output from the respective drivers 63, 64, 65, 66R, and 66L, the control signals are converted by the interface section 67 into the drive signals, the actuators (in the present embodiment, the drive circuit in the anterior thereof) corresponding to a plurality of nozzles of the liquid jet heads 2 and 3, the gate roller motor 17, the pickup roller motor 51, the right side electric motor 11R, and the left side electric motor 11L respectively operate, thus the feeding and conveying the print medium 1, posture control of the print medium 1, and the print process to the print medium 1 are performed. It should be noted that the elements inside the control section 62 are electrically connected to each other via a bus (not shown).

Figure 3:
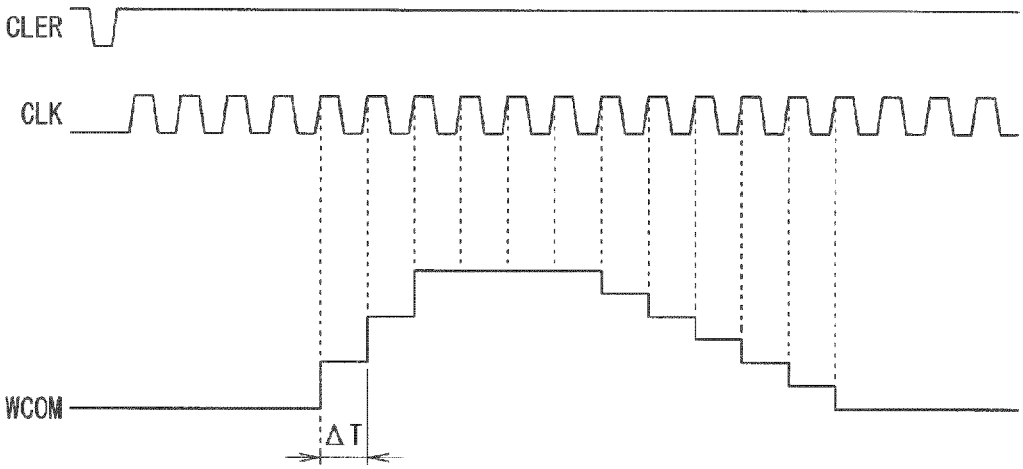
FIG. 3 is an explanatory diagram of generation of the drive waveform signal.

The head driver 65 is provided with a drive waveform generator 70 for forming drive waveform signal WCOM and an oscillator circuit 71 for outputting a clock signal SCK. The drive waveform generator 70 is, as described in detail below, for generating the drive waveform signal WCOM, which becomes the basis for the drive pulse to the actuator 22, and as shown in FIG. 3. After inputting the clear signal CLER, the drive waveform generator 70 retrieves the waveform data stored in the waveform data memory described below and outputs the voltage signal composed of the waveform data to form the drive waveform signal WCOM for every predetermined period ΔT defined by the clock signal CLK. The drive waveform signal WCOM is power-amplified and converted into the drive pulse to the actuator 22 by the drive circuit composed of a digital power amplifier and a low-pass filter described later.

Figure 4:
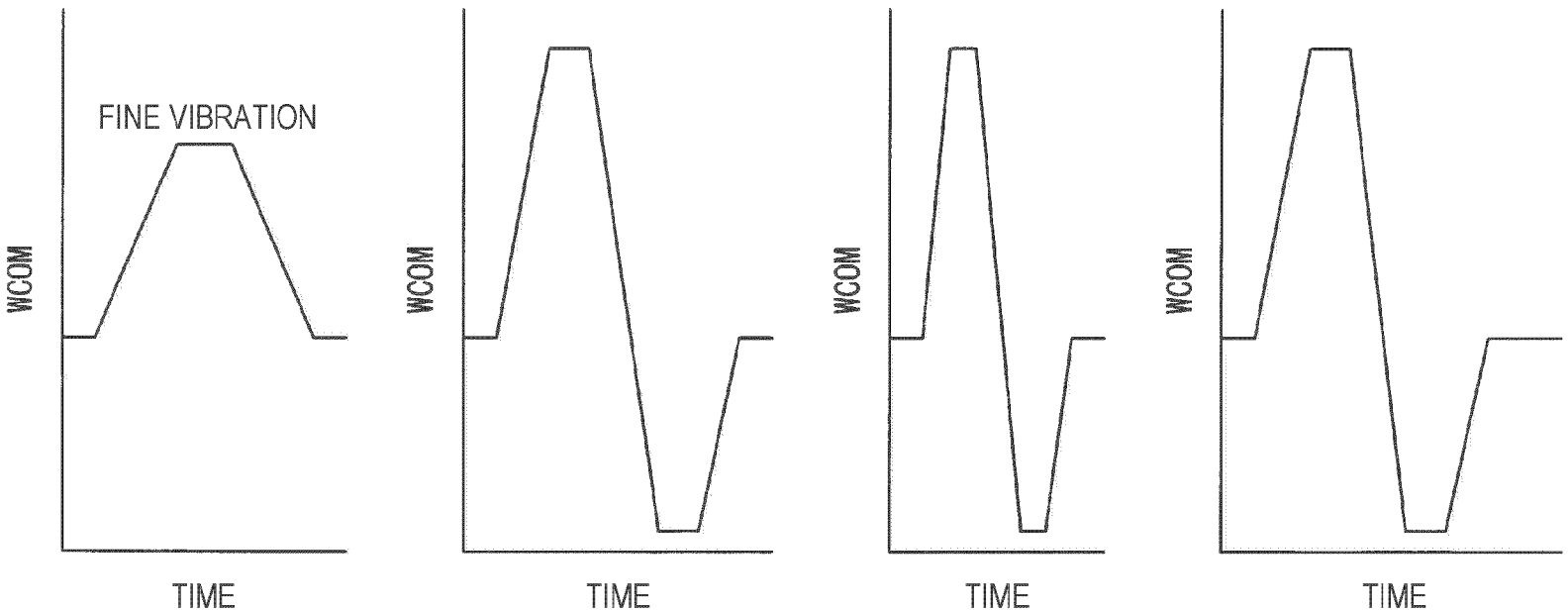
FIG. 4 is an explanatory diagram of the drive waveform signals in various forms.
Figure 5:
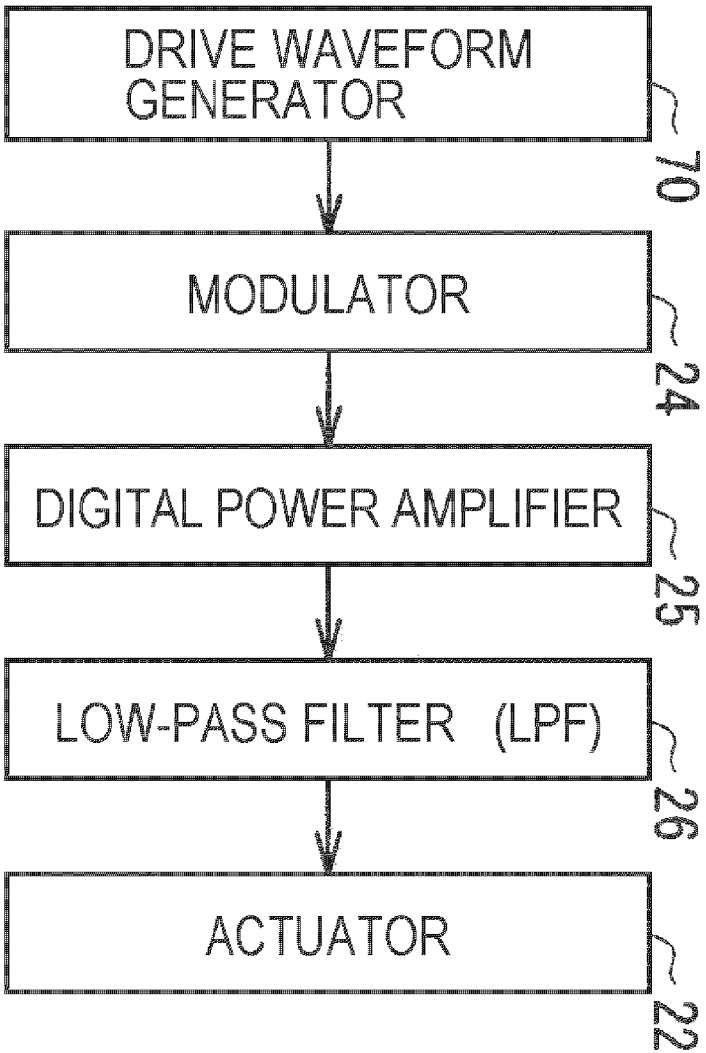
FIG. 5 is a block diagram of the drive circuit as a unit.

The drive waveform signal WCOM thus generated can be obtained as trapezoidal voltage wave signals with various waveforms shown in FIG. 4 by adjusting the waveform data. By power-amplifying this signal in the drive circuit shown in FIG. 5 and then supplying it to the actuator 22 of the liquid jet heads 2 and 3 as the drive pulse, the actuator can be driven and the liquid jet can be emitted from the nozzle corresponding to the actuator. The drive circuit is configured with for every actuator as described below, a modulator 24 for performing the pulse width modulation on the drive waveform signal WCOM generated by the drive waveform generator 70, a digital power amplifier 25 for performing the power amplification on the modulated (PWM) signal, and a low pass filter 26 for smoothing the modulated (PWM) signal power-amplified by the digital power amplifier 25.

The rising portion of the drive waveform signal WCOM or the drive pulse corresponds to the stage of expanding the capacity of the cavity (pressure chamber) communicating to the nozzle to pull in the liquid (it can be said that the meniscus is pulled in considering the emission surface of the liquid), and the falling portion of the drive signal COM corresponds to the stage of reducing the capacity of the cavity to push out the liquid (it can be said that the meniscus is pushed out considering the emission surface of the liquid), as a result of pushing out the liquid, the liquid jet is emitted from the nozzle. The series of waveform signals from pulling in the liquid to pushing out the liquid according to desired output form the drive pulse.

By variously changing the gradient of increase and decrease in voltage and the height of the drive pulse formed of this trapezoidal voltage wave, the pull-in amount and the pull-in speed of the liquid, and the push-out amount and the push-out speed of the liquid can be changed, therefore, the amount of liquid jet can be changed to obtain a different size of liquid dot, and by forming liquid dots with different sizes, finer tone can be achieved. It should be noted that the drive pulse shown in the left end of FIG. 4 is only for pulling in the liquid but not for pushing out the liquid. This is called a fine vibration, and is used for preventing the nozzle from drying when not emitting the liquid jet.

Figure 6:
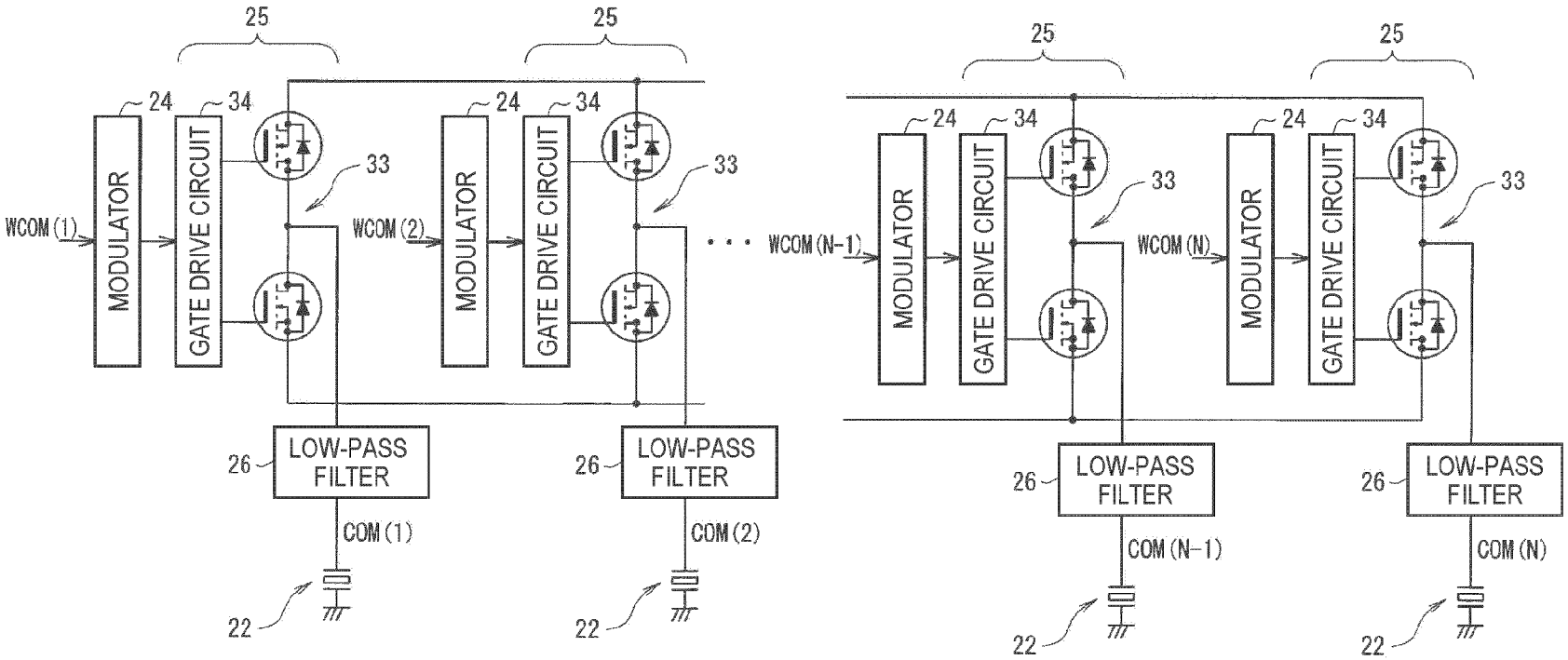
FIG. 6 is a block diagram showing the overall configuration of the drive circuit.

FIG. 6 shows the overall configuration of the drive circuit separately provided to each of the actuators 22. As described above, since in the present embodiment the individual drive waveform signal WCOM to each of the actuators 22 is set by the drive waveform generator 70, assuming that the number of the actuators 22 is N, N drive waveform signals WCOM(1) through WCOM(N) are output and applied to the N actuators 22 via the individual drive circuits.

Figure 7:
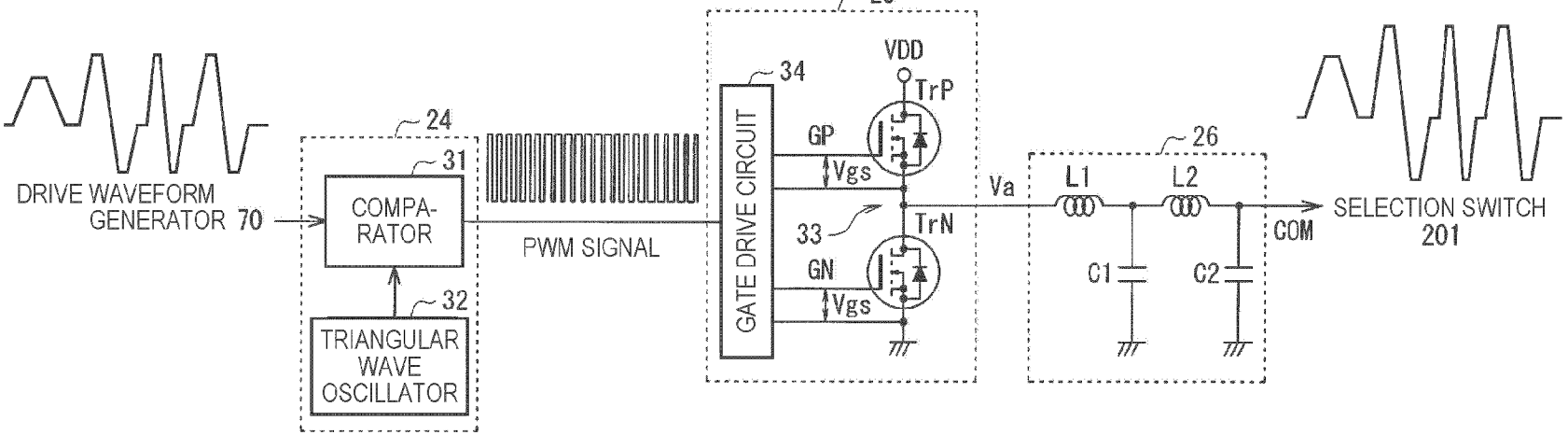
FIG. 7 is a block diagram showing details of the modulator, the digital power amplifier, and the low-pass filter of the drive circuit shown in FIG. 5.
Figure 8:
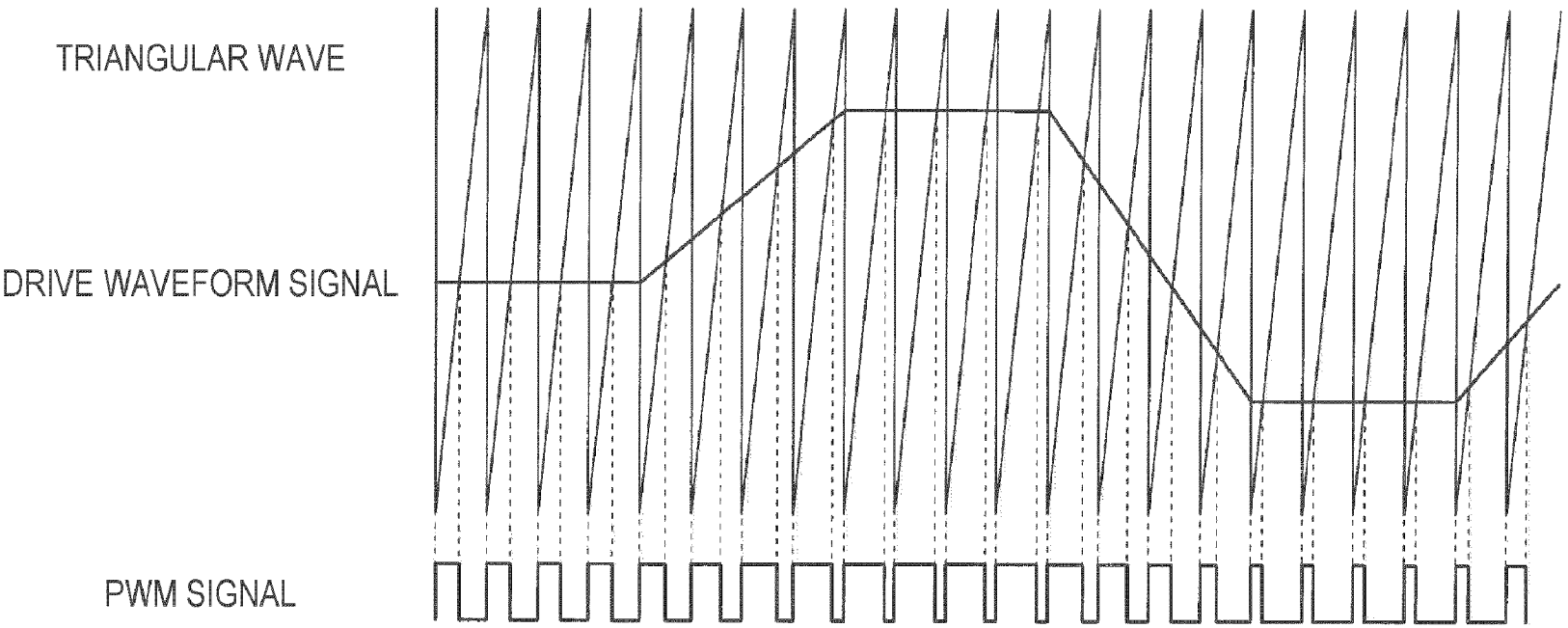
FIG. 8 is an explanatory diagram of the operation of the modulator shown in FIG. 7.

FIG. 7 shows a specific configuration of the modulator 24 of the drive signal output circuit described above. As the modulator 24 for performing the pulse width modulating on the drive waveform signal WCOM, a common pulse width modulation (PWM) circuit is used. The modulator 24 is composed of a well known triangular wave oscillator 32, and a comparator 31 for comparing the triangular wave output from the triangular wave oscillator 32 with the drive waveform signal WCOM. According to the modulator 24, as shown in FIG. 8, the modulated (PWM) signal is set to HIGH when the drive waveform signal WCOM is higher than the triangular wave, and is set to LOW when the drive waveform signal WCOM is lower than the triangular wave. It should be noted that although in the present embodiment a pulse width modulation circuit is used as the modulator, a pulse density modulation (PDM) circuit can also be used.

Figure 9:
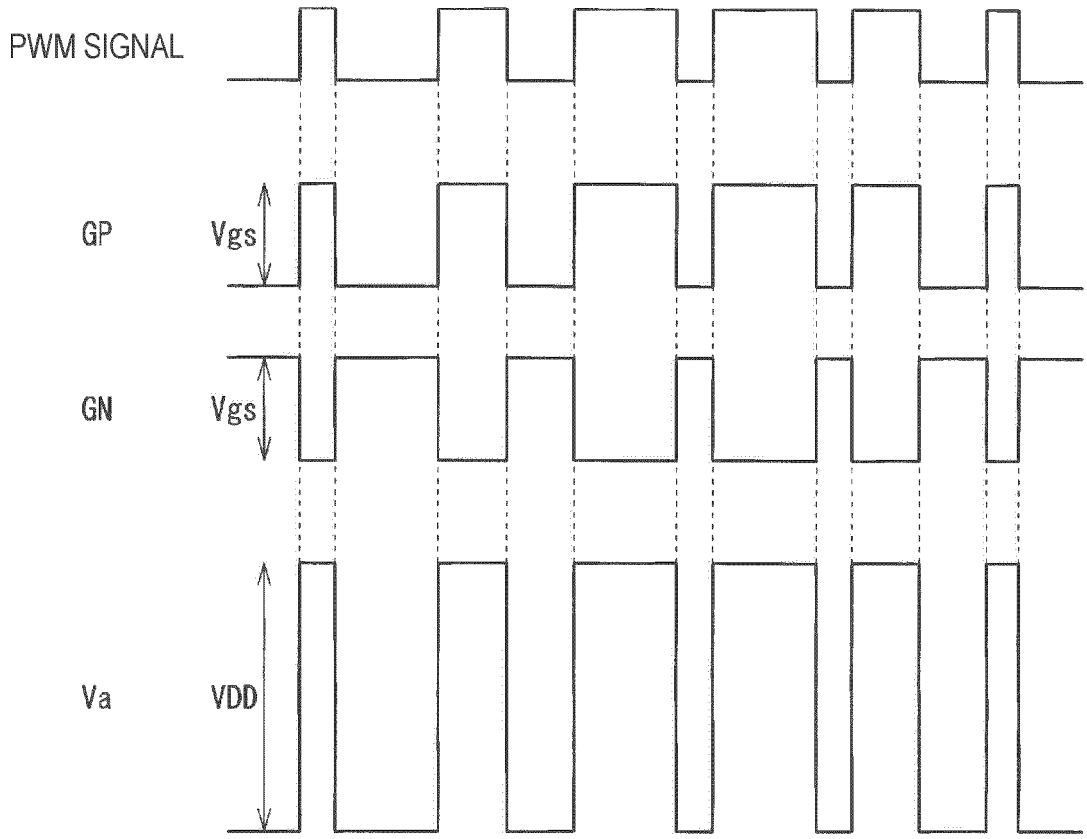
FIG. 9 is an explanatory diagram of the operation of the digital power amplifier shown in FIG. 8.

The digital power amplifier 25 is configured including a half-bridge driver stage 33 composed of a MOSFET TrP and TrN for substantially amplifying the power, and a gate drive circuit 34 for controlling the gate-source signals GP and GN of the MOSFET TrP and TrN based on the modulated (PWM) signal from the modulator 24, and the half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 9 shows how these signals vary in accordance with the modulated (PWM) signal. It should be noted that the voltage values Vgs of the gate-source signals GP and GN of the respective MOSFET TrP and TrN are assumed to be sufficient to turn on the MOSFET TrP and TrN.

When the modulated (PWM) signal is in the HIGH level, the gate-source signal GP of the high-side MOSFET TrP becomes the HIGH level while the gate-source signal GN of the low-side MOSFET TrN becomes the LOW level, the high-side MOSFET TrP becomes the ON state while the low-side MOSFET TrN becomes the OFF state, and as a result, the output Va of the half-bridge driver state 33 becomes the supply voltage VDD. On the other hand, when the modulated (PWM) signal is in the LOW level, the gate-source signal GP of the high-side MOSFET TrP becomes the LOW level while the gate-source signal GN of the low-side MOSFET TrN becomes the HIGH level, the high-side MOSFET TrP becomes the OFF state while the low-side MOSFET TrN becomes the ON state, and as a result, the output Va of the half-bridge driver state 33 becomes zero.

The output Va from the half bridge driver stage 33 of the digital power amplifier 25 is supplied as a drive signal COM to the selection switch 201 via the low pass filter 26. The low pass filter 26 includes a combination of two coils L1 and L2 and two capacitors C1 and C2. The low pass filter 26 is designed to sufficiently attenuate a high-frequency component, i.e., a amplified digital signal (PWM) component of the output Va from the half bridge driver stage 33 of the digital power amplifier 25 and not to attenuate a drive signal component COM (or drive waveform component WCOM).

As described above, when the MOSFET TrP and TrN of the digital power amplifier 25 are driven in a digital manner, since the MOSFET acts as a switch element, although the current flows in the MOSFET in the ON state, the drain-source resistance is extremely small and the power loss is small. Further, since no current flows in the MOSFET in the OFF state no power loss occurs. Therefore, the power loss of the digital power amplifier 25 is extremely small, a small-sized MOSFET can be used, and a cooling unit, such as a heat radiation plate, can be eliminated. Incidentally, the efficiency when the transistor is driven in the linear range is about 30% while the efficiency of a digital power amplifier is higher than 90%. Further, since the heat radiation plate for cooling the transistor is about 60 mm square in size for each transistor, if such a radiation plate can be eliminated, an overwhelming advantage in the actual layout can be obtained.

Figure 10:
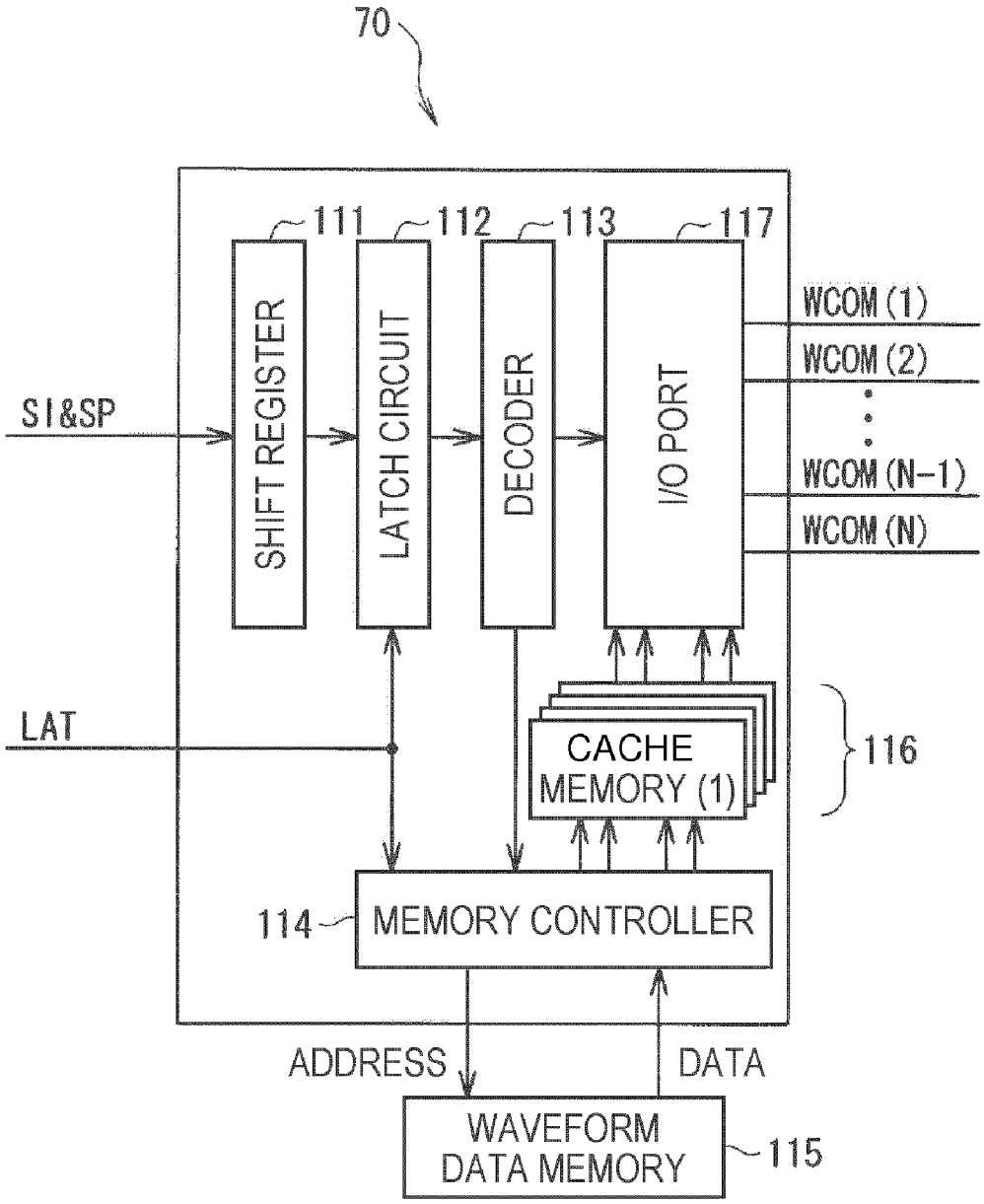
FIG. 10 is a block diagram of a drive waveform generator.

The configuration and the operation of the drive waveform generator 70 will now be explained. The drive waveform generator 70 is configured as shown in FIG. 10, and provided with a shift resistor 111 for sequentially storing the drive pulse selection data SI & SP for designating the actuator corresponding to the nozzle from which the liquid jet is emitted, a latch circuit 112 for temporarily storing the data of the shift register 111 in accordance with a latch signal LAT, a decoder 113 for decoding the data of the latch circuit 112, a waveform data memory 115 for storing the waveform data corresponding to the actuator 22 as described above, a memory controller 114 for retrieving the waveform data stored in the waveform data memory 115 and storing it in a cache memory 116 corresponding to the actuator 22 in accordance with the data decoded by the decoder 113 and the latch signal LAT by performing the arithmetic process shown in FIG. 12 described below, and an I/O port 117 for outputting the waveform data stored in the cache memory 116 to the modulator 24 of the drive circuit in accordance with the latch signal LAT and the data decoded by the decoder 113.

The reason why the drive waveform generator 70 outputs the drive waveform signals WCOM corresponding to the actuators 22 will be explained. Since the actuator 22, formed of a piezoelectric element or the like, has a capacitance, if all of the actuators for emitting the liquid jet are connected to one drive pulse in parallel to each other, a low-pass filter is formed of the parasitic inductances, the parasitic capacitances, and the resistances of the actuators and the wiring of the drive circuit, therefore, the drive pulses are distorted. Moreover, since the characteristic of the low-pass filter created by the capacitances of the actuators varies when the number of nozzles for emitting the liquid jet, namely the number of actuators to be driven, varies the state of the distortion of the drive pulse also varies. Every time the actuator 22, such as a piezoelectric element, is connected to the low-pass filter, the capacitances are additionally connected in parallel one after another, thus the characteristic of the complete low-pass filter formed by the low-pass filter and the capacitances of the actuators can be varied. When the state of the distortion of the drive pulse varies, the amount of liquid emitted from the nozzle also varies, as a matter of course.

Therefore, in the present embodiment, an individual drive circuit is provided for each of the actuators 22, and an individual drive waveform signal WCOM is output to each of the drive circuits and, therefore, to each of the actuators 22. Since the variation in the distortion of the drive pulse in accordance with the variation in the number of the actuators 22 is eliminated by providing the individual drive circuit to each of the actuators 22, the variation in the amount of liquid emitted from the nozzle can be suppressed even with a common drive waveform signal WCOM. However, individual differences also exist in the nozzles and the actuators 22 themselves, and accordingly, even if the drive circuits of the actuators 22 are provided individually, a variation in the liquid jet emitted from different nozzles is caused by the common drive waveform signal WCOM.

In consideration of the individual difference among the nozzles and the actuators 22, in the present embodiment, as shown in FIG. 11A, small liquid dot waveform data (small ink droplet waveform data, in the drawing) of the drive waveform signal most appropriate for the drive pulse when forming a small liquid dot, medium liquid dot waveform data (medium ink droplet waveform data, in the drawing) of the drive waveform signal most appropriate for the drive pulse when forming a medium liquid dot, and large liquid dot waveform data (large ink droplet waveform data, in the drawing) of the drive waveform signal most appropriate for the drive pulse when forming a large liquid dot are obtained for N nozzles and actuators by measurement, and the data is stored into the waveform data memory 115 corresponding to the address numbers 1 though M in the order of the nozzle number 1 through N.

In this case, the memory controller 114 accesses the address number 2 of the waveform data memory 115 in FIG. 11A in accordance with the drive pulse selection data SI & SP when the medium liquid dot is required for the nozzle number 1, accesses the address number 4 of the waveform data memory 115 when the small liquid dot is required for the nozzle number 2, and stores the waveform data stored therein corresponding to these address numbers in the cache memory 116 corresponding thereto. The waveform data stored in all of the cache memories 116 are simultaneously output from the I/O port 117 as the drive waveform signals WCOM in a predetermined sampling cycle after a predetermined period of time t has elapsed from the latch signal LAT.

It should be noted that in order to decrease the storage capacity of the waveform data memory 115, similar waveform data to all of the actuators 22 of the nozzles shown in FIG. 11A are combined, and stored corresponding to the addresses by a shape like small ink droplet waveform data A, medium ink droplet waveform data A, large ink droplet waveform data A, small ink droplet waveform data B, medium ink droplet waveform data B, and so on as shown in FIG. 11B. In this case, the memory controller 114 accesses the address number 5 of the waveform data memory 115 in FIG. 11B in accordance with the drive pulse selection data SI & SP when the medium liquid dot is required for the nozzle number 1, accesses the address number 1 of the waveform data memory 115 when the small liquid dot is required for the nozzle number 2, and stores the waveform data stored therein corresponding to these address numbers in the cache memory 116 corresponding thereto. The waveform data stored in all of the cache memories 116 are simultaneously output from the I/O port 117 as the drive waveform signals WCOM in a predetermined sampling cycle after a predetermined period of time t has elapsed from the latch signal LAT.

Figure 12:
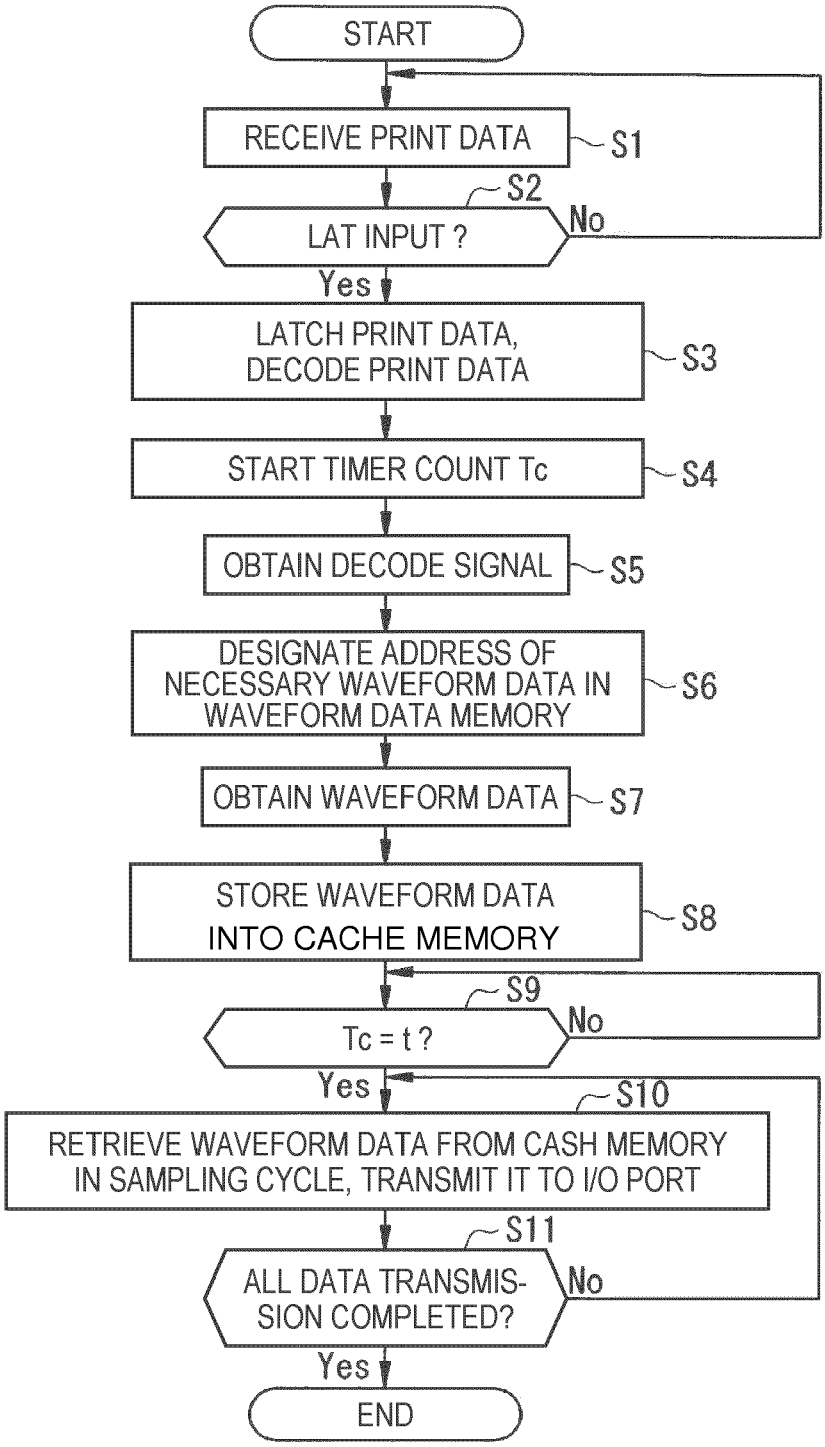
FIG. 12 is a flowchart showing an arithmetic process of waveform data output performed by the memory controller shown in FIG. 10.

FIG. 12 shows the arithmetic process for retrieving and outputting the waveform data performed in the memory controller 114 of FIG. 10. In this arithmetic process, the drive pulse selection data (print data in the drawing) SI & SP is first received in step S1.

Subsequently, the process proceeds to step S2 to determine whether or not the latch signal LAT is input, and if the latch signal LAT has been input, the process proceeds to step S3, otherwise the process proceeds to step S1.

In step S3, the drive pulse selection data (the print data) SI & SP thus received is latched by the latch circuit 112, and further deciphered (decoded in the drawing) by the decoder 113.

Then, the process proceeds to step S4 to start the timer count Tc.

Subsequently, the process proceeds to step S5 to obtain the data (the decoder signal in the drawing) deciphered by the decoder 113.

Then, the process proceeds to step S6 to designate the address of the waveform data memory 115 to obtain the waveform data necessary for each of the actuators.

Then, the process proceeds to step S7 to access the address of the waveform data memory 115, thus obtaining the waveform data necessary for each of the actuators.

Subsequently, the process proceeds to step S8 to store the waveform data obtained in the S7 into the corresponding cache memory 116.

Subsequently, the process proceeds to step S9 to judge whether or not the timer count Tc has reached the predetermined time period t, and if the timer count Tc has reached the predetermined time period t, the process proceeds to step S10, otherwise the process enters the standby state.

In step S10, the waveform data is retrieved from the cache memory 116 in the sampling cycle, and output from the I/O port 117.

Subsequently, the process proceeds to step S11 to judge whether or not the transmission of all of the waveform data has been completed, and if the transmission of all of the waveform data has been completed, the process returns to the main program, otherwise the process proceeds to step S10.

Figure 13:
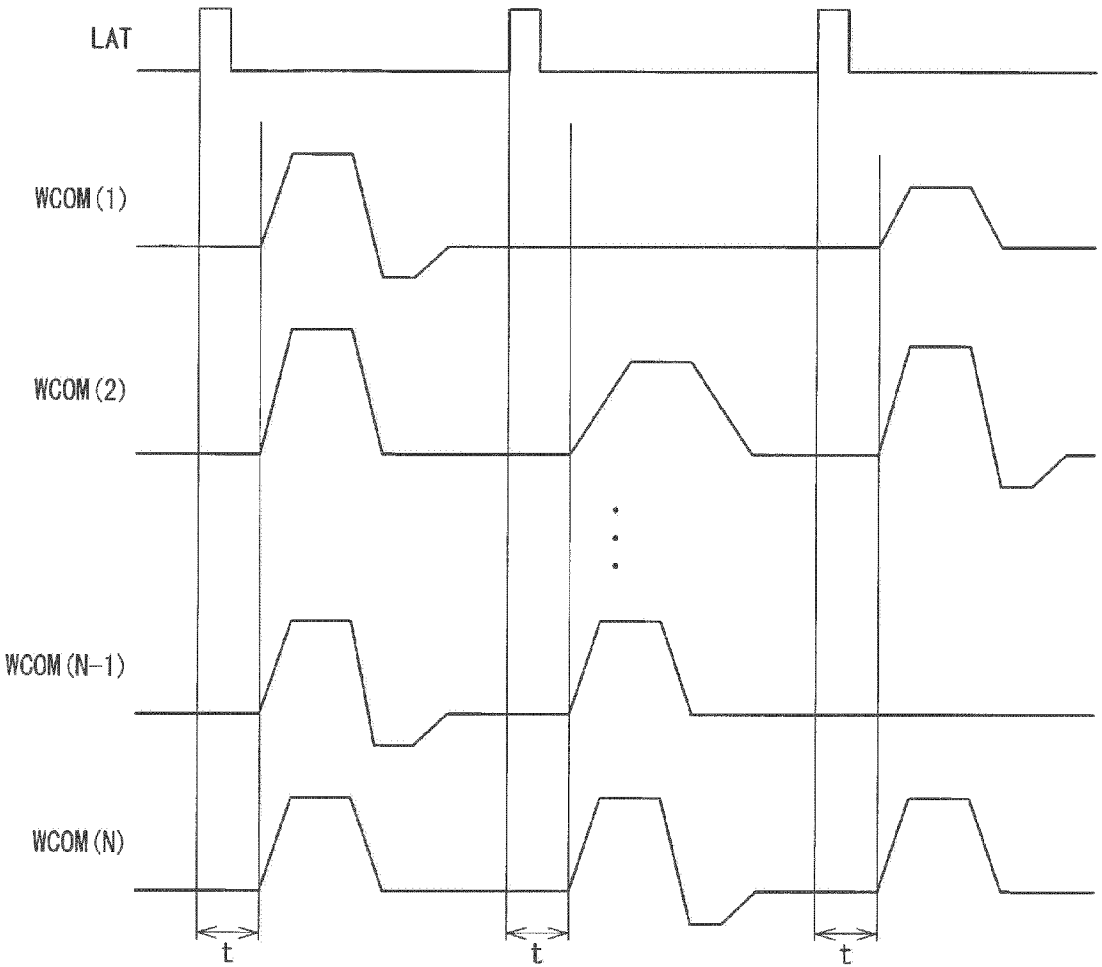
FIG. 13 is an explanatory diagram of a drive waveform signal by the arithmetic process shown in FIG. 12.

According to the arithmetic process, as shown in FIG. 13, the waveform data is output every predetermined sampling time period after the predetermined time period t has elapsed from the latch signal LAT, thus the drive waveform signals WCOM are output simultaneously to the actuators 22 of all of the nozzles from which the liquid jets are emitted, and the signals are power-amplified by the respective drive circuits to be converted into the drive pulses, and are applied to the respective actuators 22. Since only one actuator 22 is connected to one drive pulse, the drive pulse is never distorted.

As described above, according to the printing apparatus of the present embodiment, the same number of half-bridge driver stages 33 (each composed of two transistors MOSFET TrP, TrN forming a pair connected in a push-pull manner) as the number of actuators are provided for power-amplifying the drive waveform signals WCOM as a basis of the drive pulses to the actuators 22. The low-pass filters 26 are provided between the connection points of the pairs of transistors MOSFET TrP, TrN of the half-bridge driver stages 33 and the actuators 22, resulting in only one actuator 22 connected to the drive circuit composed of the half-bridge driver stage 33 and the low-pass filter 26. Therefore, the waveform distortion of the drive pulse can be prevented, eliminating and/or preventing variation in the amount of liquid jetted, thereby making it possible to perform high quality, fine tone, printing.

Further, since the number of modulators 24 for performing the pulse-modulation of the drive waveform signals WCOM and the number of gate drive (driving) circuits 34 for driving the half-bridge driver stages 33 (the transistor pairs) based on the pulse-modulated modulation signal is the same as the number of half-bridge driver stages 33 and are provided to individually control the half-bridge driver stages 33 in accordance with the respective drive waveform signals WCOM, the variation in the amount of liquid jetted among the nozzles can be suppressed and prevented by generating drive waveform signals WCOM corresponding to the actuators 22 of the drive circuits and the nozzles, thus making it possible to perform high quality, fine tone, printing.

Further, by generating the drive waveform signal WCOM for every corresponding actuator 22 in accordance with the waveform data corresponding to the actuator 22 and stored in the waveform data memory 115, the variation in the amount of liquid jetted among the nozzles can be suppressed and prevented, thus making it possible to perform high quality, fine tone, printing.

Further, when the configuration of simultaneously generating the drive waveform signals WCOM to all of the actuators 22 corresponding to the nozzles from which the liquid jets are emitted with the timing of emitting the liquid jets from the nozzles is adopted, the shift in the liquid jet emission timing among the nozzles can be prevented, thus making it possible to perform high quality, fine tone, printing.

Further, since the modulators 24, the gate drive (driving) circuits 34, the half-bridge driver stages 33 (the transistor pairs), and the low-pass filters 26 are disposed adjacent to the actuators 22 as an integrated circuit, the power loss can be reduced to achieve low power consumption, and a plurality of liquid jet heads can efficiently be arranged, thus reduction in the size of the printing apparatus becomes possible.

Further, since the transistor pair is connected to every actuator 22, the current flowing through the transistor pair can be reduced, thus it becomes possible to configure the transistor pair using transistors capable of operating at higher speed to increase the modulation frequency to simplify the low-pass filter. For example, the low-pass filter can be composed of a first-order RC filter, or can be composed of only a resistor utilizing the capacitance of the actuator, or can be composed of the resistor components of the wiring and the transistors and the capacitance component of the actuator without separately providing a low-pass filter.

It should be noted that although in the present embodiment, applying the present invention using a line head printing apparatus, the liquid jet apparatus and the printing apparatus according to the present invention can also be applied to a multi-pass printing apparatus or any other types of printing apparatuses for printing letters or images on a print medium by emitting liquid jet as a target thereof. Further, each section configuring the liquid jet apparatus or the printing apparatus of the present invention can be replaced with an arbitrary configuration capable of exerting a similar function, or added with an arbitrary configuration.

Further, as a liquid emitted from the liquid jet apparatus of the present invention, there is no particular limitation, and liquids (including dispersion liquids such as suspensions or emulsions) containing various kinds of materials as mentioned below can be cited, for example. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on a substrate W, various coating materials, a liquid electrode material for forming a electrode, a particle material for forming a spacer for forming a microscopic cell gap between two substrates, a liquid metal material for forming metal wiring, a lens material for forming a microlens, a resist material, a light diffusion material for forming a light diffusion material, and so on can be cited.

Further, in the present invention, the print medium to be a target of the liquid jet emission is not limited to a piece of paper such as a recording sheet, but can be a film, a cloth, a nonwoven cloth, or other medium, or works such as various substrates such as a glass substrate, or a silicon substrate.

The invention claimed is:

1. A liquid jet apparatus comprising:

a plurality of nozzles;

an actuator provided for each nozzle and connected to the respective nozzle;

a drive waveform signal generation unit that generates a drive pulse for each actuator; and a drive unit for each actuator for applying the drive pulse to the respective actuator, wherein the drive unit includes:

a transistor pair, wherein the transistor pair:

has two transistors connected to each other in a push-pull manner; and power-amplifies the drive pulse; and a low-pass filter disposed between the transistor pair and the actuator.

2. The liquid jet apparatus according to claim 1, each drive unit further comprising:

a modulator unit for pulse-modulating the drive pulse to produce a modulated signal; and a gate drive unit for driving the transistor pair in accordance with the modulated signal.

3. The liquid jet apparatus according to claim 2, further comprising a waveform data memory for storing waveform data corresponding to the actuators, wherein the drive waveform signal generation unit generates the drive pulse for each actuator in accordance with the corresponding waveform data stored in the waveform data memory.

4. The liquid jet apparatus according to claim 3, wherein the drive waveform signal generation unit provides the drive pulses simultaneously with the timing of emitting the liquid jet from the nozzles to all of the actuators corresponding to the nozzles from which the liquid jet is to be emitted.

5. The liquid jet apparatus according to claim 2, wherein the drive unit is disposed adjacent to the actuators as an integrated circuit.

6. A printing apparatus comprising:

a plurality of nozzles for a liquid jet head;

an actuator provided for each of nozzle and connected to the respective nozzle;

a drive waveform signal generation unit that generates a drive pulse for each actuator; and a drive unit for each actuator that applies the drive pulse to the respective actuator, wherein the drive unit includes:

a transistor pair, wherein the transistor pair:

has two transistors connected to each other in a push-pull manner, and power-amplifies the drive pulse; and a low-pass filter disposed between the transistor pair and the actuator.

7. The printing apparatus according to claim 6, the drive unit further comprising:

a modulator unit for pulse-modulating the drive pulse to produce a modulated signal; and a gate drive unit for driving the transistor pair in accordance with the modulated signal.

8. The printing apparatus according to claim 7, further comprising a waveform data memory for storing waveform data corresponding to the actuators, wherein the drive waveform signal generation unit generates the drive pulse for each actuator in accordance with the corresponding waveform data stored in the waveform data memory.

9. The printing apparatus according to claim 8, wherein the drive waveform signal generation unit provides the drive pulses simultaneously with the timing of emitting the liquid jet from the nozzles to all of the actuators corresponding to the nozzles from which the liquid jet is to be emitted.

10. The printing apparatus according to claim 7, wherein the drive unit is an integrated circuit disposed adjacent to the actuators.

* * * * *